United States Patent [19]

Amano et al.

[11] Patent Number: 4,522,178

[45] Date of Patent: Jun. 11, 1985

[54] METHOD OF FUEL CONTROL IN ENGINE

[75] Inventors: Matsuo Amano; Shinichi Sakamoto, both of Hitachi; Takeshi Hirayama, Mito; Takao Sasayama, Hitachi, all of Japan

[73] Assignee: Hitachi, Ltd., Tokyo, Japan

[21] Appl. No.: 471,435

[22] Filed: Mar. 2, 1983

[30] Foreign Application Priority Data

Mar. 3, 1982 [JP] Japan ..... 57-32345

[51] Int. Cl.[3] ..... F02B 3/00

[52] U.S. Cl. ..... 123/478

[58] Field of Search ..... 123/492, 480, 494, 478, 123/488, 490

[56] References Cited

U.S. PATENT DOCUMENTS 4,112,879 9/1978 Assenheimer ..... 123/492
4,205,377 5/1980 Oyama ..... 123/480
4,257,377 3/1981 Kinugawa ..... 123/492
4,385,611 5/1983 Harper ..... 123/492
4,389,994 6/1983 Denz ..... 123/480

*Primary Examiner*—Ronald B. Cox
*Attorney, Agent, or Firm*—Antonelli, Terry & Wands

[57] ABSTRACT

A method of controlling fuel supplied to an engine comprises the steps of computing the quantity of air taken into the engine on the basis of the output from an air flow rate sensor, integrating the quantity of intake air computed in the first step, determining the level for setting the period of generation of a fuel-quantity control pulse signal from a pulse generating circuit on the basis of the output from an exhaust gas sensor, and generating pulses of predetermined pulse width from the pulse generating circuit when a predetermined relation is attained between the level determined in the third step and the result of integration in the second step.

5 Claims, 14 Drawing Figures

METHOD OF FUEL CONTROL IN ENGINE

This invention relates to an engine control apparatus, and, more particularly, to a fuel control system for an engine of an automobile in which a microcomputer or digital computer is used for controlling fuel supplied to the engine.

For the purpose of improving the engine control function, a microcomputer or digital computer is now commonly used for controlling fuel supplied to engines. The quantity of fuel supplied to the engine is so controlled that a certain relationship is maintained between the supply fuel and the quantity of air taken into the engine. The quantity of engine intake air is measured or computed on the basis of the intake manifold pressure and rotation speed of the engine or is directly sensed by a hot-wire type flow rate sensor. In the latter case, on the basis of the quantity of intake air thus sensed, the quantity of intake air per suction stroke is computed, and fuel, in a quantity corresponding to the result of computation, is supplied to the engine in a synchronous relationship with rotation of the engine. Since thus fuel is supplied to the engine in synchronous relationship with the rotation of the engine, the fuel supply system including fuel injection valves has been required to be capable of operation with high accuracy over a wide operation range. For example, it has been required for the fuel supply system to accurately meter a small quantity of fuel in an idling condition of the engine and to accurately meter a large quantity of fuel in a heavy loaded condition of the engine. The above requirement has led to an undesirable increase in the cost of the fuel supply system. The operation range of the fuel supply system can be narrowed by shortening the time interval of fuel supply in the heavy loaded condition of the engine. In other words, the disadvantages of the prior art can be avoided by supplying fuel to the engine in asynchronous relation with rotation of the engine. However, there have been no methods for supplying fuel to an engine in asynchronous relation with rotation of the engine.

It is therefore a primary object of the present invention to provide a method of fuel control in an engine according to which fuel is supplied to the engine in asynchronous relation with rotation of the engine.

In accordance with the present invention, a fuel control system is provided which includes a plurality of sensors sensing various operation parameters of an engine, a digital computer controlling the quantity of fuel supplied to the engine depending on the outputs from the sensors, a pulse generating circuit generating a pulse signal for controlling the quantity of supplied fuel in response to the output from the digital computer, and fuel supplying means for supplying fuel on the basis of the pulse signal generated from the pulse generating circuit. The method of controlling fuel supplied to the engine comprises the steps of computing the quantity of air taken into the engine on the basis of the output from one of the sensors, integrating the quantity of intake air computed in the first step, determining the level for setting the period of generation of the pulse signal on the basis of the output from one of the sensors, and generating pulses of predetermined pulse width from the pulse generating circuit when a predetermined relation is attained between the level determined in the third step and the result of integration in the second step.

According to the present invention, the fuel supply period is varied to control the quantity of fuel supplied to the engine. Therefore, there is little variation in the quantity of fuel supplied per operation of the fuel supply system, so that the operable range of the fuel supply system may be narrower than hitherto. Depending on the manner of control, the quantity of fuel supplied per operation of the fuel supply system can be made completely constant. Also, the quantity of fuel supplied per operation of the fuel supply system can be varied as a function of one or more of engine control parameters. In each of the above cases, the range of variation of the quantity of fuel supplied per operation of the fuel supply system can be made narrower. This facilitates the manufacture and adjustment of the fuel supply system. The fuel supply system may be of the injection type including the fuel injection valves or of the suction type in which the vacuum produced in the air intake pipe is utilized for suction of fuel.

The present invention will now be described in detail with reference to the accompanying drawings, in which.

A preferred embodiment of the present invention will now be described in detail with reference to the drawings.

Figure 1:
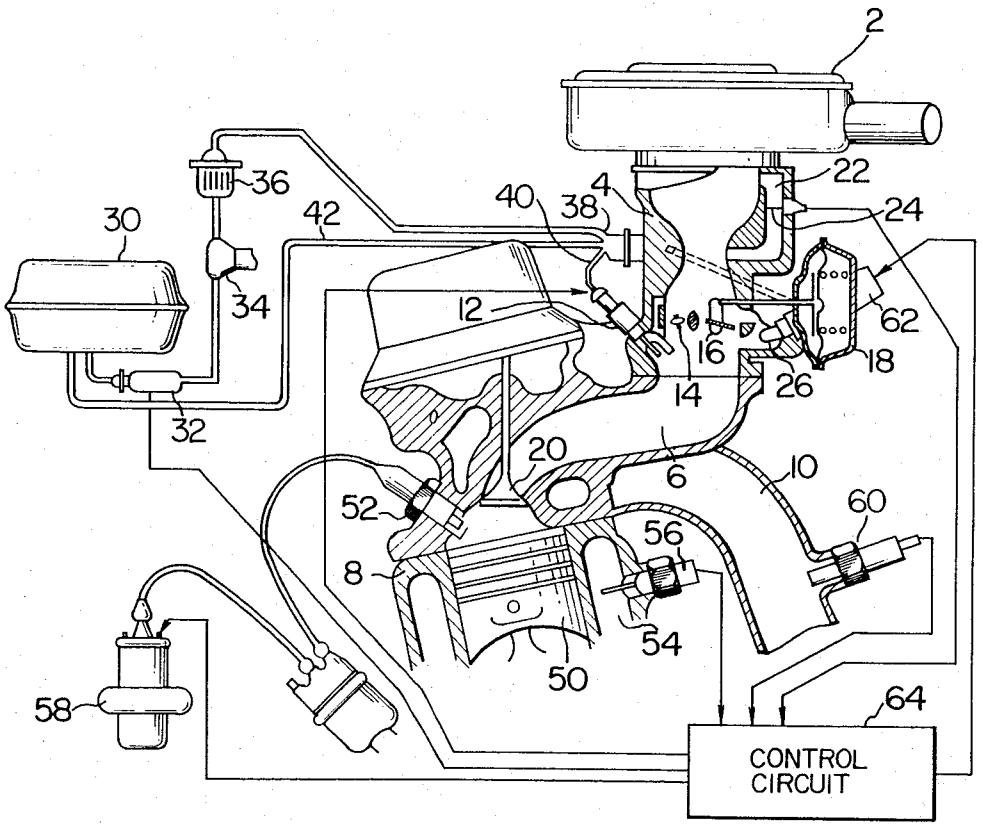
FIG. 1 is a schematic general view of engine systems including an embodiment of the fuel control system according to the present invention.

Referring now to the drawings wherein like reference numerals are used throughout the various views and, more particularly, to FIG. 1, according to this figure intake air is supplied to a cylinder 8 of an engine through an air cleaner 2, a throttle chamber 4 and an intake pipe 6. Exhaust gases from the cylinder 8 are discharged to the atmosphere through an exhaust pipe 10.

An injector 12 for injecting fuel is disposed in the throttle chamber 4. Fuel injected from the injector 12 is atomized in the air passage of the throttle chamber 4 to be mixed with intake air, and the air-fuel mixture thus formed passes through the intake pipe 6 to be supplied into the combustion chamber of the cylinder 8 when an intake valve 20 is opened.

Throttle valves 14 and 16 are disposed in the throttle chamber 4 in the vicinity of the outlet of the injector 12. The throttle valve 14 is mechanically coupled to the accelerator pedal to be actuated by the driver. On the other hand, the throttle valve 16 is disposed to be actuated by a diaphragm 18 and is in its full closed position in a region in which the flow rate of intake air is small. With the increase in the flow rate of intake air, hence, with the increase in the negative pressure or vacuum acting upon the diaphragm 18, the throttle valve 16 is progressively opened to decrease the resistance to the air flow.

An air passage 22 is provided upstream of the throttle valves 14 and 16 in the throttle chamber 4. An electrical heat generator 24 functioning as a thermal type air flow-rate sensor is disposed in this air passage 22 to generate an electrical signal whose level varies depending on the velocity of intake air or is determined by the relationship between the velocity of intake air and the heat transmitted to air from the heat generator. The heat generator 24 is disposed in the air passage 22 so that it is protected against high-temperature gases produced in the event of back fire and it is also protected against contamination by foreign matters including dust contained in intake air. The outlet of this air passage 22 opens in the vicinity of the narrowest area of the venturi, and its inlet opens at a position upstream of the venturi.

Although not shown in FIG. 1, a throttle angle sensor for sensing the opening of the throttle valves 14 and 16 is associated with the throttle valves 14 and 16, and the output signal from this throttle angle sensor is shown as an output signal from a throttle angle sensor 116 shown in FIG. 2 described later. Such an output signal is applied to a multiplexer 120 in a first analog-digital converter shown in FIG. 2.

Fuel to be injected from the injector 12 is supplied from a fuel tank 30 to a fuel pressure regulator 38 through a fuel pump 32, a fuel damper 34 and a fuel filter 36. Fuel under regulated pressure is supplied from the fuel pressure regulator 38 to the injector 12 through a pipe 40. In order that the difference between the internal pressure of the intake pipe 6 into which fuel is injected from the injector 12 and the pressure of fuel injected from the injector 12 can be maintained constant, fuel is returned from the fuel pressure regulator 38 to the fuel tank 30 through a return pipe 42.

The air-fuel mixture supplied into the cylinder 8 through the intake valve 20 is compressed by a piston 50 and ignited by a spark generated by a spark plug 52, the combustion being converted into kinetic energy. The cylinder 8 is cooled by cooling water flowing through a jacket 54, and a water temperature sensor 56 senses the temperature of cooling water to generate an output signal which is indicative of the temperature of the engine. A high voltage is supplied from an ignition coil 58 to the spark plug 52 at the ignition timing.

A crank angle sensor is associated with the crankshaft (not shown) of the engine to generate a reference angle signal and a position signal at angular intervals of a reference crank angle and a fixed angle (of, for example, 0.5°) respectively during rotation of the engine.

The output signals from this crank angle sensor are applied, together with the output signal from the water temperature sensor 56 and the electrical signal from the heat generator 24, to a control circuit 64 including a microcomputer or like digital computer to be arithmetically and logically processed by the control circuit 64. The control circuit 64 generates its control outputs for actuating the elements including the injector 12 and ignition coil 58.

Figure 2:
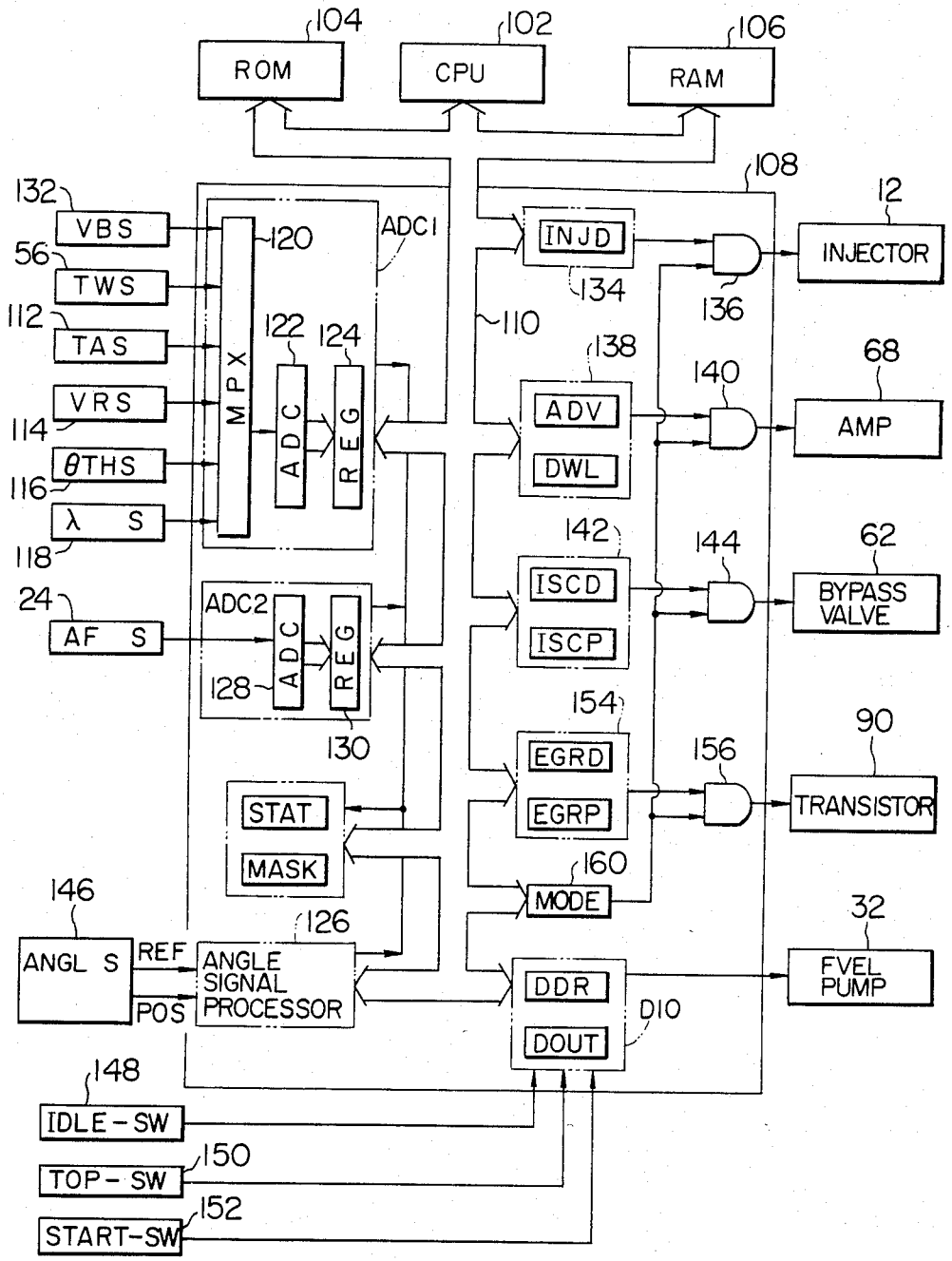
FIG. 2 is a block diagram of the fuel control system according to the present invention.

Referring to FIG. 2, the control system includes a central processing unit (abbreviated hereinafter as a CPU) 102, a read-only memory (abbreviated hereinafter as an ROM) 104, a random access memory (abbreviated hereinafter as an RAM) 106, and an input-output interface circuit (abbreviated hereinafter as an I/O interface circuit) 108. In accordance with various programs stored in the ROM 104, the CPU 102 executes arithmetic and logic processing on various input data applied from the I/O interface circuit 108, and the results of operation are returned to the I/O interface circuit 108 again. The RAM 106 is used as an intermediate memory for data required for such arithmetic and logic processing. A bus line 110 including a data bus, a control bus and an address bus is provided for transfer of various data between the CPU 102, ROM 104, RAM 106 and I/O interface circuit 108.

The I/O interface circuit 108 includes input means including a first analog-digital converter (referred to hereinafter as an ADCl), a second analog-digital converter (referred to hereinafter as an ADC2), an angle signal processing circuit 126, and a discrete input-output circuit (referred to hereinafter as a DIO) provided for the input and output of 1-bit information.

The output from a battery voltage sensor (referred to hereinafter as a VBS) 132, the output from the water temperature sensor (referred to hereinafter as a TWS) 56, the output from an atmospheric temperature sensor (referred to hereinafter as a TAS) 112, the output from a regulated voltage generator (referred to hereinafter as a VRS) 114, the output from a throttle angle sensor (referred to hereinafter as a $\theta$THS) 116 and the output from a $\lambda$ sensor (referred to hereinafter as a $\lambda$S) 118 are applied to a multiplexer (referred to hereinafter as an MPX) 120 in the ADCl, and one of these inputs is selected by the MPX 120 at a time to be applied to an analog-digital conversion circuit (referred to hereinafter as an ADC) 122. As a result of the analog-digital conversion, a digital data appears from the ADC 122 to be registered in a register (referred to hereinafter as an REG) 124.

The output from the flow rate sensor (referred to hereinafter as an AFS) 24 is applied to the ADC2 to be converted into a digital data by an analog-digital conversion circuit (referred to hereinafter as an ADC) 128, and the digital data is registered in a register (referred to hereinafter as an REG) 130.

An angle sensor (referred to hereinafter as an ANGLS) 146 generates an output signal (referred to hereinafter as an REF) indicative of a reference crank angle of, for example, 180°, and generates also an output signal (referred to hereinafter as a POS) indicative of a very small crank angle of, for example, 1°. These signals REF and POS are applied to the angle signal processing circuit 126 to be subjected to wave shaping.

An idle switch (referred to hereinafter as an IDLE-SW) 148, a top gear switch (referred to hereinafter as a TOP-SW) 150 and a starter switch (referred to hereinafter as a START-SW) 152 are connected at their outputs to the DIO.

On the basis of the results of arithmetic and logic processing of input data in the CPU 102, various objects to be controlled are controlled through associated pulse output circuit 134. An injector control circuit (referred to hereinafter as an INJC) 134 converts the corresponding digital data applied from the CPU 102 as a result of arithmetic and logic processing, into a pulse output signal. Therefore, a pulse signal having a pulse width corresponding to the quantity of fuel to be injected from the injector 12 is applied from the INJC 134 to the injector 12 through an AND gate 136.

An ignition pulse generating circuit 138 (referred to hereinafter as a JGNC) includes a register (referred to hereinafter as an ADV) for setting the ignition timing and a register (referred to hereinafter as a DWL) for setting the timing of starting primary current supply to the ignition coil 58, and these data are registered from the CPU 102. On the basis of the registered data, an ignition pulse signal is applied from the JGNC 138 to an amplifier 68 through an AND gate 140.

A valve-opening control circuit 142 (referred to hereinafter as an ISCC) applies a pulse signal to a bypass valve 62 shown in FIG. 1 through an AND gate 144 to control the opening of the bypass valve 62. This ISCC 142 includes a register (referred to hereinafter as an ISCD) for setting the pulse width and a register (referred to hereinafter as an ISCP) for setting the pulse recurrence period.

An EGR rate control pulse generating circuit 154 (referred to hereinafter as an EGRC) 154 controls a transistor 90 which controls an EGR control valve (not shown). This EGRC 154 includes a register (referred to hereinafter as an EGRD) for setting the duty factor of the pulse signal and a register (EGRP) for setting the pulse recurrence period. The pulse output signal from the EGRC 154 is applied to the transistor 90 through an AND gate 156.

The DIO controls 1-bit input and output signals. The 1-bit input signals include those from the IDLE-SW 148, TOP-SW 150 and START-SW 152. The 1-bit output signals include that applied to the fuel pump 32. This DIO includes a register (referred to hereinafter as a DDR) for determining as to whether the terminal functions as an input terminal or an output terminal and a register (referred to hereinafter as a DOUT) for latching the output data.

A mode register (referred to hereinafter as an MODE) is provided for registering instructions commanding various internal statuses of the I/O interface circuit 108. For example, an instruction for turning off or turning on all of the AND gates 136, 140, 144 and 156 is registered in this MODE 160. Thus, by registering such an instruction in the MODE 160, the INJC 134, IGNC 138 and ISCC 142 can be disabled or abled as required.

Figure 3:
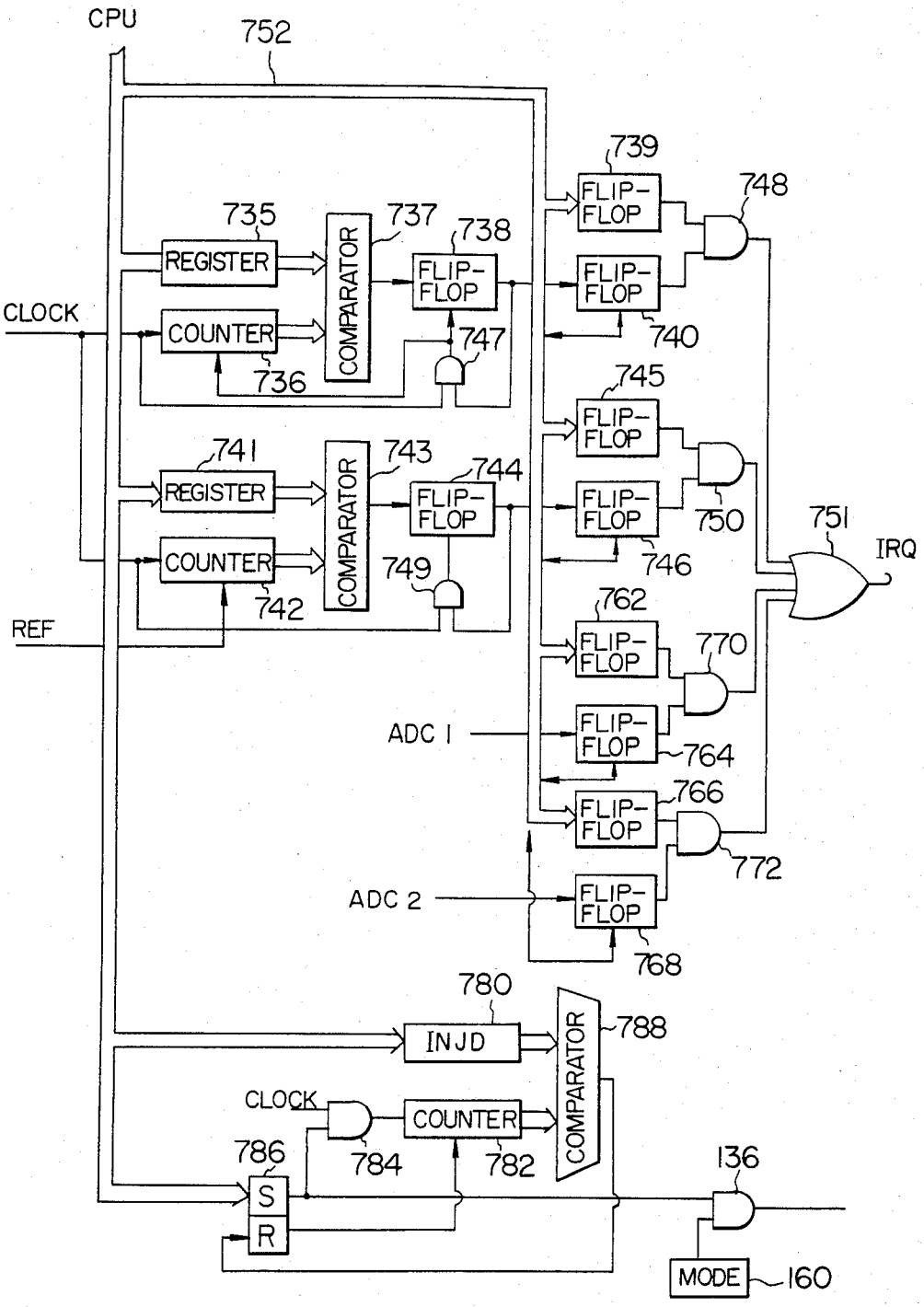
FIG. 3 shows in detail the structure of the interrupt request circuit and fuel injection pulse generating circuit shown in FIG. 2.

Referring to FIG. 3, an interrupt request (IRQ) generating circuit and a fuel injection pulse generating circuit are shown. Referring to FIG. 3, a register 735, a counter 736, a comparator 737 and a flip-flop 738 constitute a fixed-time interrupt request (INTV IRQ) generating circuit. The value indicative of the INTV IRQ generation period which is, for example, 100 μsec in the present embodiment is registered in the register 735. The counter 736 counts clock pulses so that the flip-flop 738 is set each time the count of the counter 736 coincides with the setting registered in the register 735. As soon as the flip-flop 738 is set, the counter 736 is cleared to re-start its counting operation. Therefore, the interrupt signal INTV IRQ is generated at the predetermined time interval of 100 μsec.

A register 741, a counter 742, a comparator 743 and a flip-flop constitute an interrupt request (ENST IRQ) generating circuit which generates an interrupt signal ENST IRQ when stoppage of the engine is sensed. The register 741, counter 742 and comparator 743 are similar to the register 735, counter 736 and comparator 737 respectively, and the interrupt signal ENST IRQ is generated each time the count of the counter 742 coincides with the setting registered in the register 741. However, when the engine is under rotation, the counter 742 is cleared by the pulse signal REF generated from the ANGLS 146 at the angular interval of, for example, 180°, and the count of the counter 742 can not attain the setting registered in the register 741, with the result that the interrupt signal ENST IRQ is not generated in that situation.

The interrupt signal INTV IRQ appearing from the flip-flop 738 is applied to a flip-flop 740 to be set therein, and the interrupt signal ENST IRQ appearing from the flip-flop 744 is applied to a flip-flop 746 to be set therein. Further, interrupt signals IRQ generated from the ADCl and ADC2 are applied to flip-flops 764 and 768, respectively, to be set therein. Further, a signal permitting or inhibiting appearance of such an interrupt signal IRQ is applied to each of flip-flops 739, 745, 762 and 766. Therefore, when a high level "H" is set in one of the flip-flops 739, 745, 762 and 766, the associated one of AND gates 748, 750, 770 and 772 is abled or turned on so that the interrupt signal IRQ passes through the turned-on AND gate to appear from an OR gate 751.

Therefore, appearance of the interrupt signal IRQ from the OR gate 751 can be permitted or inhibited by setting a high level "H" or a low level "L" in a selected one of the flip-flops 739, 745, 762 and 766. As soon as the interrupt signal IRQ appears from the OR gate 751, the CPU 102 fetches the contents of the flip-flops 740, 746, 764 and 768 to find out what is requested by the interrupt signal IRQ.

When the CPU 102 starts to execute a program in response to the interrupt signal IRQ, it is necessary to clear the flip-flop generating the specific interrupt signal IRQ. Therefore, one of the flip-flops 740, 746, 764 and 768 associated with the specific interrupt signal IRQ in response to which the CPU 102 starts execution of the program, is now cleared.

The INJC 134 shown in FIG. 2 includes a register (INJD) 780, a counter 782, a comparator 788, an AND gate 784 and a flip-flop 768 as shown in FIG. 3. When a "1" is set in the flip-flop 786 from the CPU 102, the AND gate 784 is turned on, and clock pulses are applied to the counter 782. The data indicative of the quantity of fuel to be supplied is set in the INJD 780 from the CPU 102. As soon as the flip-flop 786 is set, a signal of "1" level is applied from the flip-flop 786 to the AND gate 136. As described already with reference to FIG. 2, the output signal of "1" level from the flip-flop 786 is applied through the AND gate 136 to the injector 12 (FIG. 2) to cause injection of fuel, under the normal condition in which a signal of "1" level is applied from the MODE 160 to the AND gate 136. The comparator 788 resets the flip-flop 786 when it detects that the count of the counter 782 attains a predetermined relation with the setting of the INJD 780, for example, when the former coincides with the latter. Resetting of the flip-flop 786 resets the counter 782. Also, as a result of resetting of the flip-flop 786, the signal of "1" level having been applied from the flip-flop 786 to the injector 12 through the AND gate 136 disappears to cease injection of fuel.

By detecting whether or not a "1" is set in the flip-flop 786, the CPU 102 can identify that fuel is being injected or not.

Figure 4:
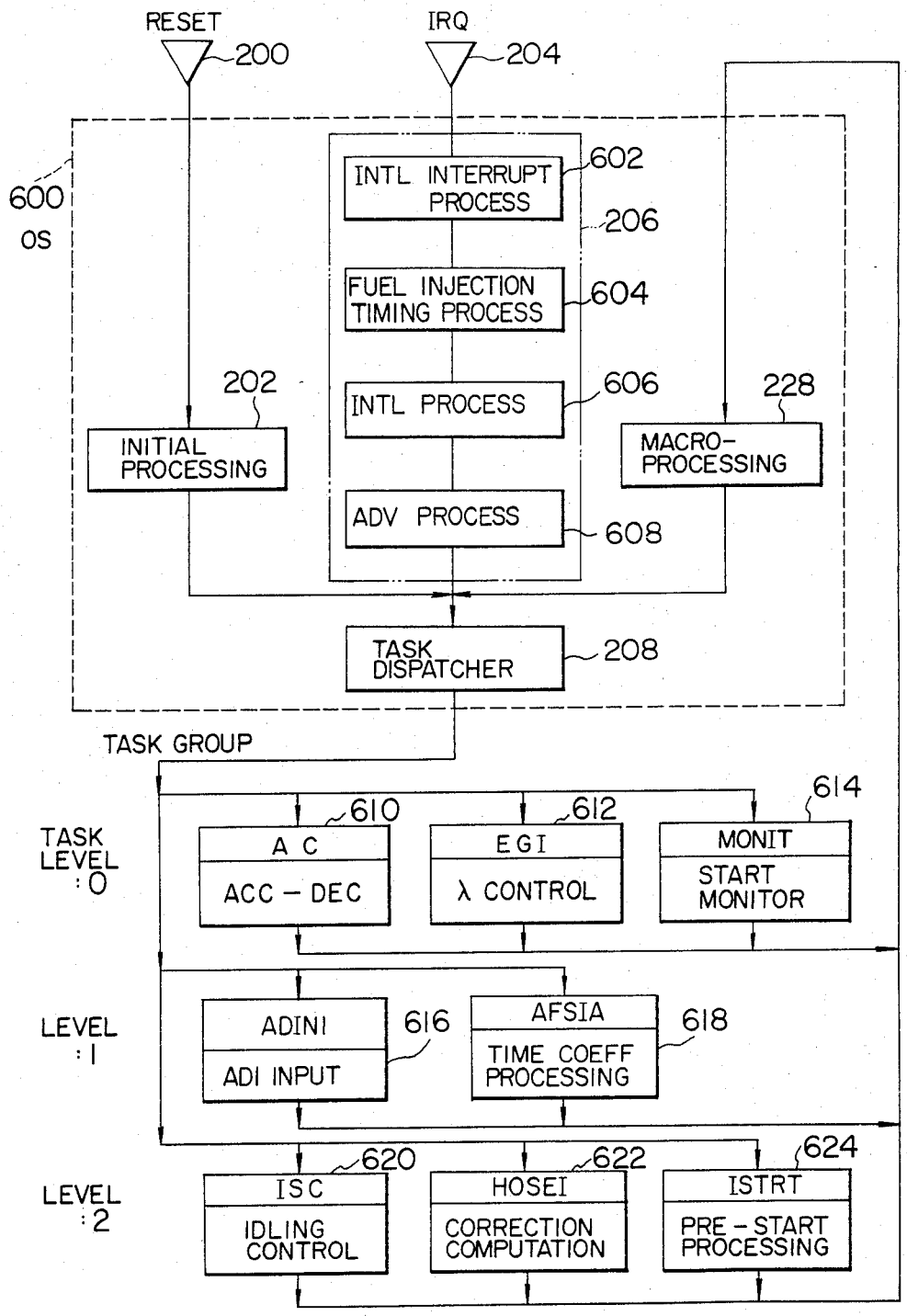
FIG. 4 is a program system diagram.

Referring to FIG. 4, an operating system (i.e. management system) OS includes an initial processing program 202, an interrupt processing program 206, a task dispatcher 208 and a macroprocessing program 228.

The interrupt processing program 206 includes various kinds of interrupt processing programs. In an initial interrupt processing program 602 (referred to hereinafter as an INTL interrupt processing program), an initial interrupt signal is generated in synchronous relation with rotation of the engine so that n initial interrupts occurs per revolution of the engine. The value of n is the half of the number of the cylinders of the engine and is two when the number of the cylinders is four. The data indicative of the fuel injection timing computed by an EGI task 612 in response to the above INTL interrupt is set in an INJD register 780 (in FIG. 3) included in the I/O interface circuit 108. An AD conversion interrupt processing program generates two kinds of interrupts, that is, an AD converter 122 interrupt (abbreviated hereinafter as an ADCl) and an AD converter 128 interrupt (abbreviated hereinafter as an ADC2). The fuel injection timing process 604 is corresponding to steps 805 to 814, and the ADV process 608 is corresponding to the steps 815 to 817. The AD converter 122 has the accuracy of 8 bits, and the data including those of the battery voltage, cooling water temperature, intake air temperature and regulated voltage are applied thereto. The AD converter 122 starts the AD conversion as soon as the input point to the multiplexer 120 is assigned, and the ADCl interrupt occurs immediately after the AD conversion. This ADCl interrupt is applied only before cranking. The data indicative of the sensed air flow rate is applied to the AD converter 128, and the ADC2 interrupt occurs immediately after the AD conversion. This ADC2 interrupt is also applied before cranking.

In an interval interrupt processing program (referred to hereinafter as an INTV interrupt processing program) 606, an INTV interrupt signal is generated at a time interval of a predetermined time of, for example, 10 msec set in an INTV register (not shown) and is used as a basic signal for monitoring the starting timing of tasks to be activated at predetermined periods. This INTV interrupt signal updates the soft timer thereby activating the mask now ready to be started. Counting is started in response to the detection of an INTL interrupt signal, and, when the next INTL interrupt signal can not be detected within a predetermined period of time of, for example, 1 sec, an ENST interrupt occurs. When the ENST interrupt occurs three times, that is, when the INTL interrupt signal can not be detected during a period of time of, for example, 3 sec, the engine is judged as having stopped, and energization of the ignition coil 58 and operation of the fuel pump 32 are ceased. After execution of these processing steps, the microcomputer stands by until the START-SW 152 is turned on. Table 1 sows the outline of processing executed in response to the interrupt signals above described.

TABLE 1

| Interrupt | Outline of processing |
|---|---|
| INTL | Ignition timing is set in the ADV register. |
| ADC1 | Task ADIN1 is activated. |
| ADC2 | Air flow-rate signal processing task AC is activated. |
| INTV | Starting timings of tasks ADIV2, EGI, AC, MONIT, ADIN1, AFSIA and ISC to be activated at predetermined periods are checked to start the task now ready to be activated and also to control the period of fuel injection. |
| ENST | ENST interrupt processing is executed to initialize the system when the engine is found stopped. |

The following tasks are activated in response to the various interrupts above described. Tasks belonging to the task level 0 include an abrupt acceleration-deceleration processing task (referred to hereinafter as an AC task), a fuel injection control task for purposes of λ control, etc. (referred to hereinafter as an EGI task) and a starting timing monitoring task (referred to hereinafter as an MONIT task). Tasks belonging to the task level 1 include an ADl input task (referred to hereinafter as an ADINl task) and a time coefficient processing task (referred to hereinafter as an AFSIA task). Tasks belonging to the task level 2 include an idling rotation control task (referred to hereinafter as an ISC task), a correcting computation task (referred to hereinafter as an HOSEI task) and a pre-starting processing task (referred to hereinafter as an ISTRT task).

Table 2 shows the allocation of the task levels and the functions of the individual tasks.

TABLE 2

| Level | Program | Task No. | Function | Activation period |
|---|---|---|---|---|
| 0 | OS | INTL | Engine-rotation-synchronous interrupt control | |
| 1 | | | Fuel injection timing process | |
| 0 | AC | 0 | Abrupt acceleration-deceleration correction | 10 msec |
| | EGI | 1 | Adjustment of integration flow-rate level (λ control) | 20 msec |
| | MONIT | 3 | Monitoring of START-SW (OFF), control of fuel injection timing in starting stage, start-stop of soft timers | 40 msec |
| 1 | ADIN1 | 4 | Correction and filtering of inputs to AD converter 122 | 50 msec |
| | AFSIA | 6 | Control of after-starting, after-idling and after-acceleration time coefficients | 120 msec |
| 2 | ISC | 8 | Idling rotation speed control | 200 msec |
| | HOSEI | 9 | Correction coefficient computation | 300 msec |
| | ISTRT | 11 | Computation of EGI initial value, monitoring of START-SW (ON), start-stop of soft timers, starting of fuel pump, starting of I/O LSI | 30 msec |

Where the starting of I/O LSI means that the output of the I/O LSI is produced by setting "1" to the MODE 160 in FIGS. 2 and 3.

As will be apparent from Table 2, the activation periods of the individual tasks activated in response to the various interrupts are previously determined, and these information are stored in the ROM 104.

Figure 5:
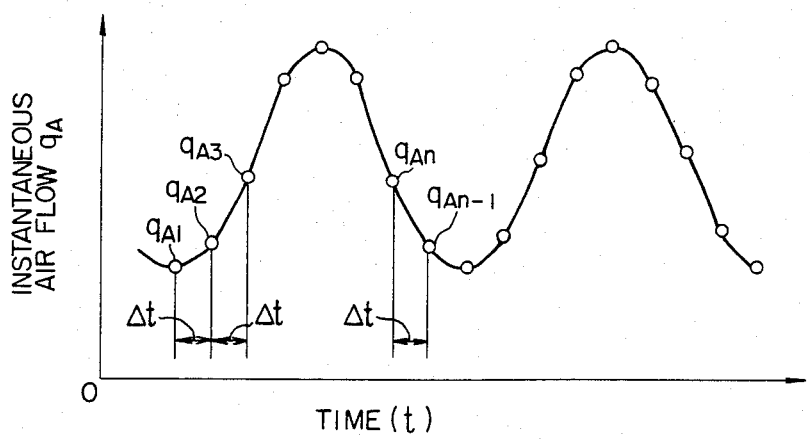
FIG. 5 is a graph showing the timing of sampling the output voltage of the hot-wire type air flow-rate sensor employed in the present invention.

FIG. 5 shows the manner of processing of the output signal from the hot-wire type flow rate sensor employed in the present invention. The instantaneous quantity of air $q_A$ can be computed from the hot-wire output voltage v. Since this instantaneous quantity of air $q_A$ pulsates as shown in FIG. 5, it is sampled at time intervals of a predetermined period of time $\Delta t$ of, for example, 100 $\mu$sec. The mean quantity of air $Q_A$ can be computed from the sampled instantaneous quantities of air $q_A$ according to the following equation:

$$Q_A = \frac{q_{A1} \cdot \Delta t + q_{A2} \cdot \Delta t + \ldots + q_{An} \cdot \Delta t}{n \cdot \Delta t} \quad (1)$$

$$= \frac{\sum_{n=1}^{n} q_{An}}{n}$$

Thus, the integrated value $$\sum_{n=1}^{n} q_{An}$$

provides the quantity of air taken into the cylinder of the engine. The integrated flow rate of air can be obtained by the above manner of signal processing.

Figure 6:
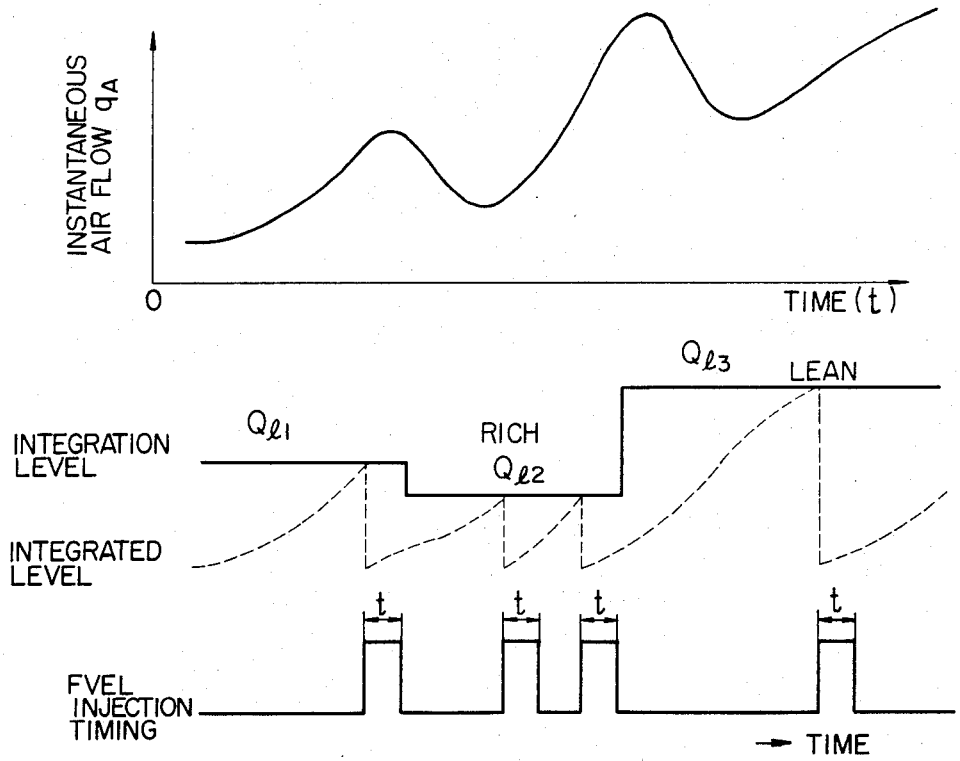
FIG. 6 is a graphic representation of the relationship between the instantaneous quantity of intake air and the fuel injection timing in the present invention.

The control of fuel injection according to the present invention will then be described. According to the present invention, the quantity of fuel injected per revolution of the engine is not computed, but fuel is injected when the integrated flow rate of air attains a certain level. The instantaneous quantity of air $q_A$ is integrated at time intervals of the predetermined period of time of 100 $\mu$sec, and, when the integrated value attains or exceeds an integration quantity level $Q_l$, fuel is injected for a predetermined period of time t as seen in FIG. 6. That is, fuel is injected at the timing at which the integrated value of the instantaneous quantity of air has attained the integration quantity level. In FIG. 6, there are shown three integration quantity levels $Q_{l1}$, $Q_{l2}$ and $Q_{l3}$. When the integration quantity level is shifted from $Q_{l1}$ to $Q_{l2}$, the air-fuel ratio (A/F) becomes richer, while when it is shifted from $Q_{l2}$ to $Q_{l3}$, the air-fuel ratio becomes leaner. According to the present invention, the integration quantity level $Q_l$ is suitably shifted so as to adjust the air-fuel ratio as described. A rich air-fuel ratio is required during warming-up in the engine starting stage, and this can be achieved by reducing the integration quantity level $Q_l$. For the optimized control of the air-fuel ratio on the basis of the output from the exhaust gas or $O_2$ sensor 60 disposed in the exhaust pipe 10, the integration quantity level $Q_l$ can be suitably adjusted by the on-off of the output from the $O_2$ sensor 60.

Figure 7:
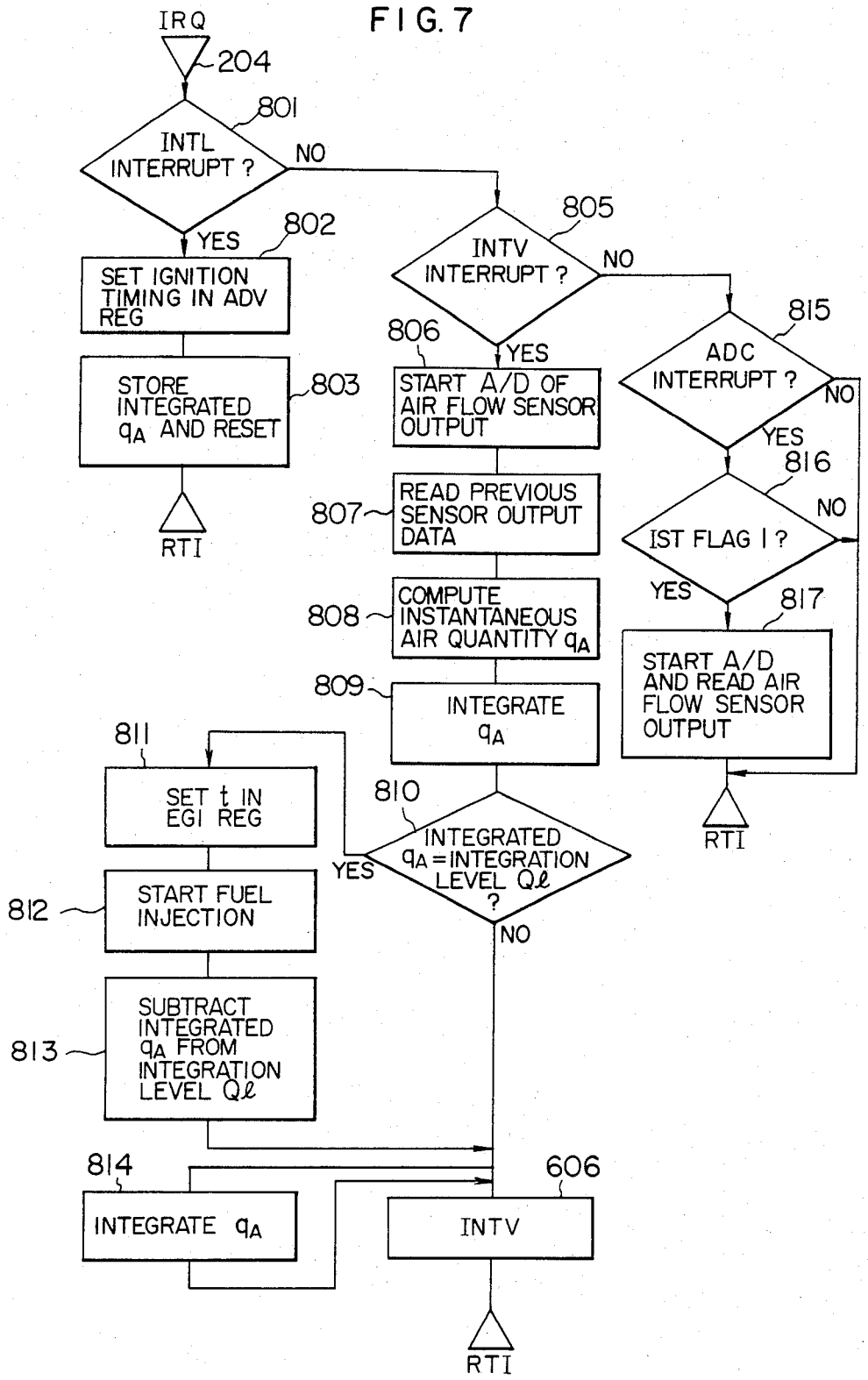
FIG. 7 is a processing flow chart of the interrupt processing according to the present invention; in which an output of a hot-wire type flow rate sensor is AD converted for determining timing of a fuel injection.

Referring to FIG. 7, judgment is made in step 801 as to whether the interrupt is an INTL interrupt or not. When the result of judgment in step 801 proves that the interrupt is an INTL interrupt, the data indicative of the ignition timing is set in the ADV REG 138, and step 803 is followed. In step 803, the integrated value of $\Delta q_A$ is stored for the purpose of detecting whether the engine is under acceleration or deceleration, and the integrator is reset for re-starting the integration. The integrating operation for obtaining this integrated value is carried out in step 814.

Whether the engine is under acceleration or deceleration is judged on the basis of the value obtained by integrating one period portion of the pulsating waveform of the instantaneous quantity of intake air $q_A$ shown in FIG. 5. Since the pulsation of intake air occurs in synchronism with rotation of the engine, the pulsating instantaneous air quantity $q_A$ is integrated in response to the INTL interrupt occurring at the angular interval of the predetermined crank angle, and whether the engine is under acceleration or deceleration is judged on the basis of this integrated value. This integrating operation is carried out in step 814. Since the period of execution of step 803 coincides with one pulsating period of intake air, the result of integration in the step 814 is stored as a new integrated value at a predetermined address in the RAM 106 in step 803, and the integrated value obtained in the step 814 is then reset so that the next integration can be carried out. The new integrated value of the quantity of intake air $q_A$ stored at the predetermined address in the RAM 106 is read out in step 901 shown in FIG. 10, described later.

Execution of the step 803 completes the INTL interrupt processing program. When, on the other hand, the result of judgment in step 801 proves that the interrupt is not an INTL interrupt, judgment is made in step 805 as to whether or not the interrupt is a timer or INTV interrupt occurring every 100 $\mu$sec. When the result of judgment in step 805 proves that the interrupt is a timer or INTV interrupt, the AD conversion by the ADC 128 is started in step 806 for converting the output voltage v of the hot-wire type flow rate sensor 24 into the corresponding digital value. Then, in step 807, the previous digital value of the output voltage v of the hot-wire type flow rate sensor 24, which has been AD-converted previously and stored in the REG 130, is read out. In step 808, the instantaneous air quantity $q_A$ is computed from the digital value of the sensor output voltage v, and, in step 809, the instantaneous air quantity $q_A$ is integrated. In step 810, judgment is made as to whether or not the integrated value of the instantaneous air quantity $q_A$ has attained the integration quantity level $Q_l$. When the result of judgment in step 810 is "YES", the data indicative of the fuel injection timing t is set in the INID REG 780 in step 811, and a "1" is set in step 812 in the flip-flop 786 shown in FIG. 3 for starting fuel injection. In step 813, the difference between the integrated air quantity and the integration quantity level $Q_l$ is computed to regard it as the present integrated air quantity. That is, when the integrated value exceeds the level $Q_l$, such an excess is taken into account in the next integration. Execution of the step 810 or 813 is followed by step 814 in which the instantaneous air quantity $q_A$ is integrated to judge whether the engine is under acceleration or deceleration as described above. Then, whether or not the execution period shown in Table 2 has reached is checked in step 606 to complete the execution.

When the result of judgment in step 805 proves that the interrupt is not a timer or INTV interrupt, judgment is made in step 815 as to whether or not the interrupt is an ADC interrupt. When the result of judgment in step 815 proves that the interrupt is an ADC interrupt, judgment is made in step 816 as to whether or not the IST flag is in state "1". When the result of judgment in step 816 is "YES", the output voltage v of the hot-wire type flow rate sensor 24 is AD-converted and stored in step 817. The thus stored digital value of the air quantity is used for detection of the start of engine due to rotation torque of wheels.

Figure 8:
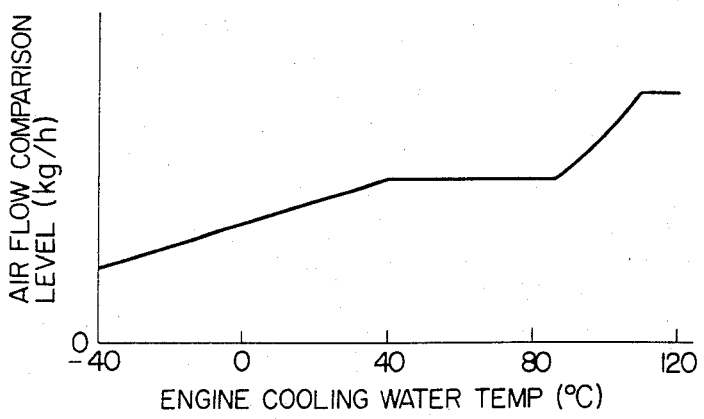
FIG. 8 shows the relationship between the temperature of engine cooling water; sensed by a temperature sensor and the air quantity comparison level.

FIG. 8 shows how the comparison level is varied relative to the output signal of the water temperature sensor 56. The temperature range of from −40° C. to 40° C. corresponds to the warming-up level in which the engine is started from its cold state. The temperature range of from 40° C. to 85° C. corresponds to the normal starting level, and the temperature range higher than 85° C. corresponds to the hot starting level. As soon as the engine key is turned on to start the engine, the sensor output signal indicative of the temperature TW of engine cooling water is applied to the ADCl so that the air quantity comparison level corresponding to the sensed temperature can be set by computation according to the relation shown in FIG. 8. The ISTRT program 624 shown in FIG. 4 is executed for this purpose.

Figure 9:
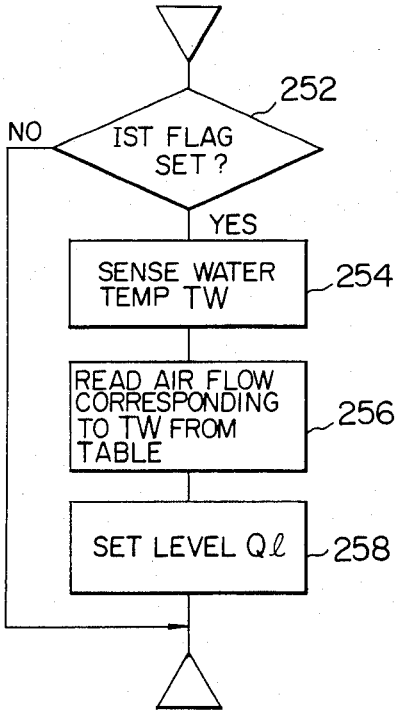
FIG. 9 is a detailed flow chart of the ISTRT program shown in FIG. 4.

FIG. 9 is a flow chart of the ISTRT program 624. The relationship between the engine cooling water temperature TW and the air quantity comparison level shown in FIG. 8 is stored in the form of a table in the ROM 104. In step 252, judgment is made as to whether or not the IST flag indicative of the fact that the engine is in its starting stage, is set. When the result of judgment in step 252 proves that the engine is now in its starting stage, the cooling water temperature TW is sensed in step 254, and the data indicative of the corresponding comparison level in FIG. 8 is read out from the table stored in the ROM 104 in step 256. This data read out from the table is set as a level setting at a predetermined address in the RAM 106. This level setting is used in the steps 810 and 813 in FIG. 7.

Figure 10:
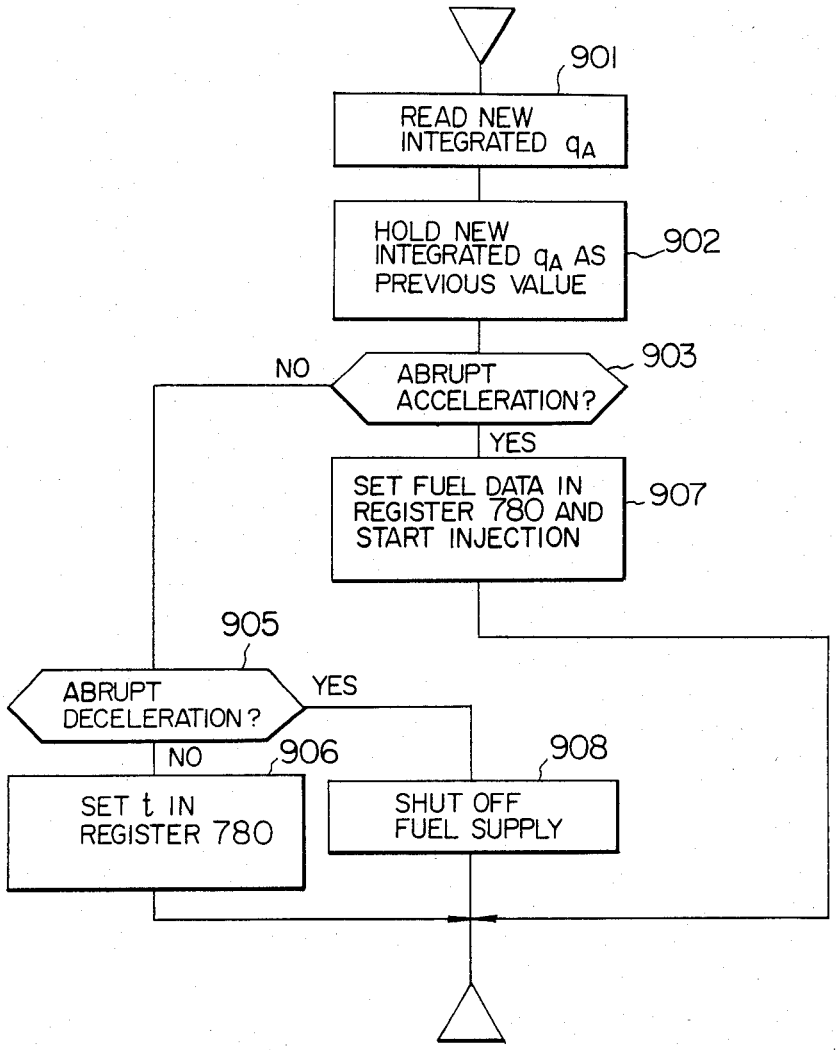
FIG. 10 is a detailed flow chart of the AC program shown in FIG. 4.

FIG. 10 is a flow chart of the AC program 610 shown in FIG. 4 to show the steps of processing when the engine under the running condition is abruptly accelerated or decelerated. The value stored in the RAM 106 in the step 803 shown in FIG. 7 is read out as a new integrated air quantity in step 901. In step 902, the difference between the new integrated air quantity and the previous one is computed, and the data indicative of the new integrated air quantity is stored at the address having been occupied by the data of the previous integrated air quantity, so that the former is used as the latter in the next processing.

Then, in step 903, judgment is made as to whether or not the value computed in step 902 is larger than a predetermined positive value, that is, judgment is made as to whether or not the engine is under abrupt acceleration. When the result of judgment in step 903 proves that the engine is under abrupt acceleration, this step 903 is followed by step 907. When, on the other hand, the result of judgment in step 903 is "NO", judgment is made in step 905 as to whether or not the value computed in step 902 is smaller than a predetermined negative value, that is, judgment is made as to whether or not the engine is under abrupt deceleration.

In step 907, the data indicative of the period of fuel injection for acceleration is set in the register 780 shown in FIG. 3, and a "1" is set in the flip-flop 786 for starting injection of fuel. The data indicative of the period of fuel injection for acceleration can be set in the register 780 even at the timing at which fuel is being injected, without giving rise to any special trouble, and the replacement of the setting of the register 780 merely extends the period of fuel injection. When the result of judgment in step 905 proves that the engine is not under abrupt deceleration, the data indicative of the predetermined fuel injection period t is set in the register 780 in step 906 to complete execution of the AC program 610. When, on the other hand, the result of judgment in step 905 proves that the engine is under abrupt deceleration, a "0" is set in step 908 in the register 780 for shutting off supply of fuel. When a "0" is thus set in step 908 in the register 780 while fuel is being injected, fuel injection is immediately ceased in response to the setting of the "0". Although the data indicative of the predetermined fuel injection period t is set in step 811 of FIG. 7 again at the next timing of fuel injection, the quantity of injected fuel can be accurately controlled to meet the condition of deceleration, due to the fact that the decrease in the quantity of intake air results in a greatly extended period of fuel injection.

Figure 11:
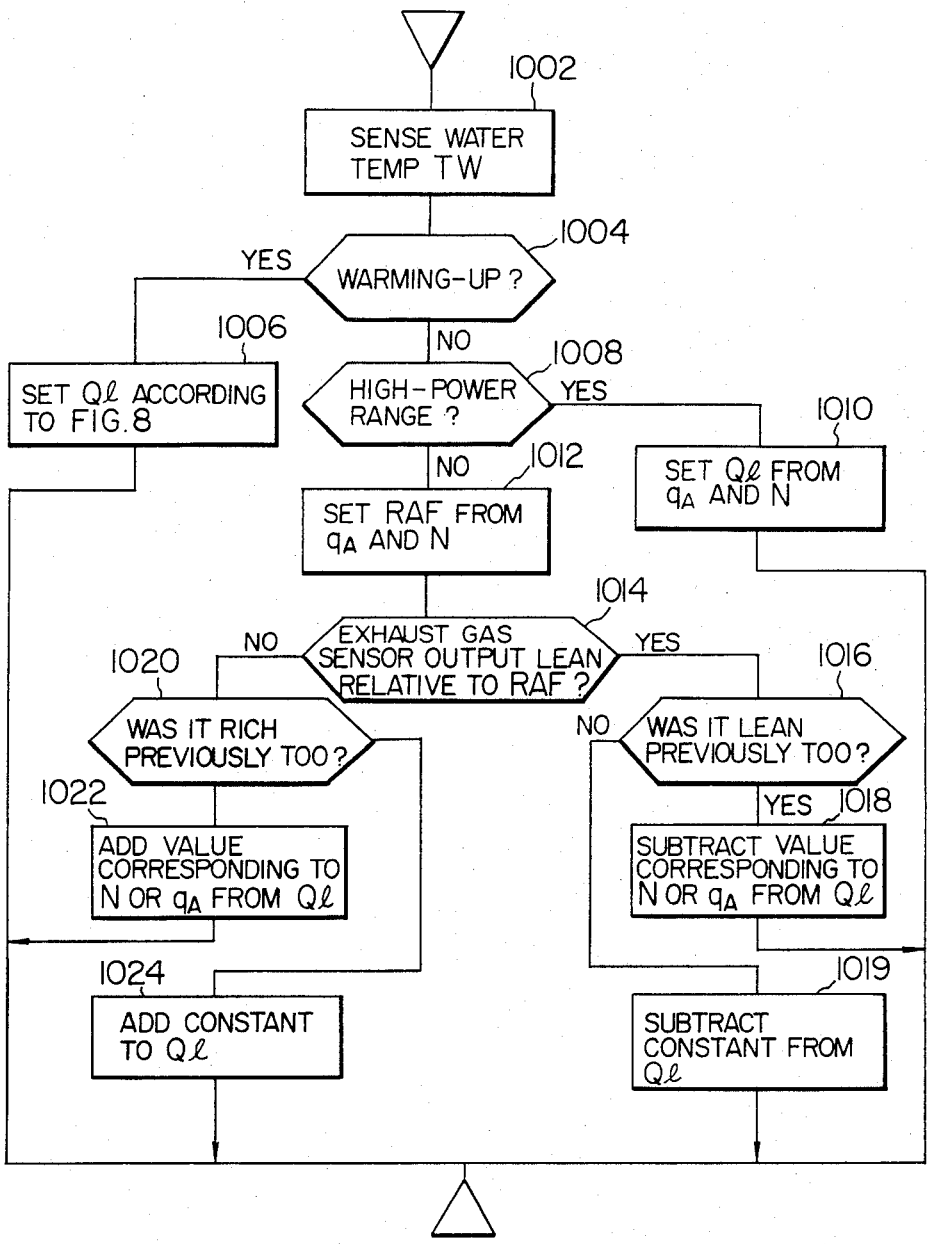
FIG. 11 is a detailed flow chart of the EGI program shown in FIG. 4.

FIG. 11 is a flow chart of the EGI program 612 shown in FIG. 4. In step 1002, the output signal indicative of the cooling water temperature TW is applied from the cooling water temperature sensor 56 to the I/O interface circuit 108. In step 1004, judgment is made as to whether or not the engine is under warming-up on the basis of the sensed water temperature TW. When the result of judgment in step 1004 proves that the engine is under warming-up, the air quantity level $Q_l$ corresponding to the sensed water temperature TW is determined in step 1006. This air quantity level $Q_l$ is used in the step 810 or 813 of FIG. 7.

On the other hand, when the result of judgment in step 1004 proves that the engine is not under warming-up, judgment is made in step 1008 as to whether or not the engine is under high-power operation. When the result of judgment in step 1008 is "YES", the level $Q_l$ is determined on the basis of the instantaneous intake air quantity $q_A$ and engine rotation speed N in step 1010. This level $Q_l$ determined in step 1010 is low since a high output is required under the high-power operation of the engine. On the other hand, when the result of judgment in step 1008 is "NO", the required value of the air-fuel ratio A/F is determined in step 1012. This value is, for example, the value of the stoichiometric point or that of a point leaner than the stoichiometric point and is determined on the basis of the engine parameters $q_A$ and N. This required A/F is designated as RAF. In step 1014, this RAF is compared with the A/F data provided by the output signal of the exhaust gas or $O_2$ sensor 60 to judge whether the A/F value is lean or rich relative to the RAF. When the result of judgment in step 1014 proves that the A/F value is lean relative to the RAF, judgment is made in step 1016 as to whether or not the previous A/F value was also lean relative to the RAF. When the result of judgment in step 1016 is "YES", a value determined by the engine parameter $q_A$ or N is subtracted from the level $Q_l$ in step 1018. When the result of judgment in step 1017 proves that the present A/F value is lean relative to the RAF although the previous A/F value was rich relative to the RAF, a predetermined value larger than that subtracted in step 1018 is subtracted from the level $Q_l$ in step 1019. On the other hand, when the result of judgment in step 1014 proves that the A/F value is rich relative to the RAF, judgment is made in step 1020 as to whether or not the previous A/F value was also rich relative to the RAF. When the result of judgment in step 1020 is "YES", a value determined by the engine parameter $q_A$ or N is added to the level $Q_l$ in step 1022. This extends the period of fuel injection and makes the air-fuel ratio leaner. On the other hand, when the result of judgment in step 1020 is "NO", a predetermined value larger than that added in step 1022 is added to the level $Q_l$ in step 1024. Execution of the step 1019 or 1024 completes the EGI program.

Figure 12:
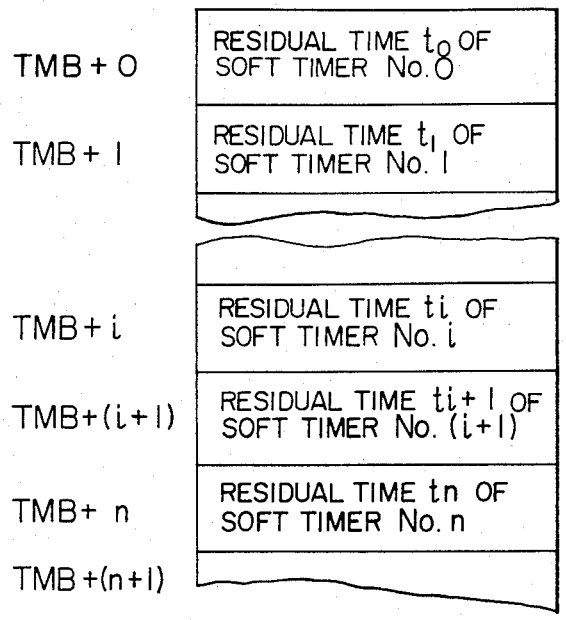
FIG. 12 shows a soft timer table provided in the RAM shown in FIG. 2.

The INTV interrupt processing program 606 will be described with reference to FIGS. 12 to 14. FIG. 12 illustrates a soft timer table stored in the RAM 106, and this soft timer table includes as many timer blocks as the number of tasks of different activation periods activated by various interrupt requests. The timer blocks referred to herein designate the memory areas to which time information pertinent to the activation periods of the tasks stored in the ROM 104 are transferred. The symbols TMB appearing at the left-hand end of FIG. 8 indicate the top addresses of the timer blocks of the soft timer table stored in the RAM 106. In the starting stage of the engine, the time information perinent to the aforesaid task activation periods are transferred from the ROM 104 to the individual timer blocks of the soft timer table. Thus, when, for example, the INTV interrupt signal is applied at the time interval of 100 μsec, the values which are integer times as large as 100 μsec are transferred from the ROM 104 to be stored in the individual timer blocks respectively of the soft timer table.

Figure 13:
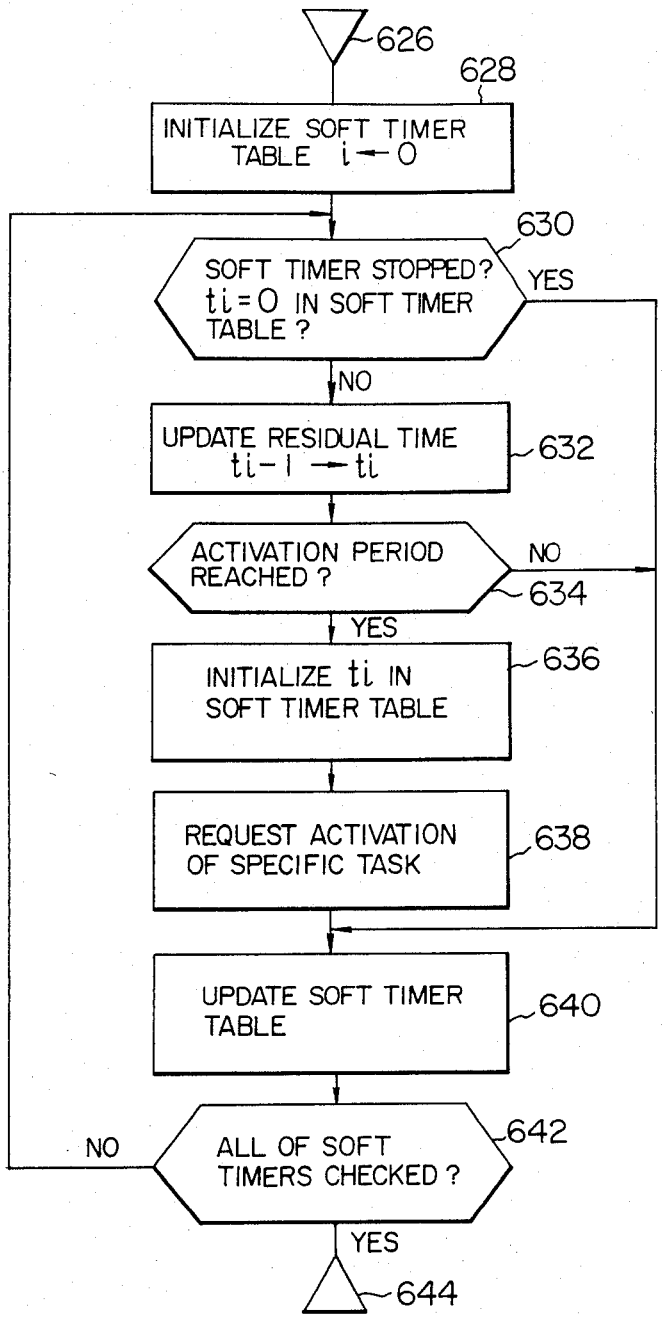
FIG. 13 is a detailed flow chart of the INTV interrupt processing program shown in FIG. 4.

In FIG. 13 the INTV interrupt processing program 606 starts in step 626. In step 628, the soft timer table stored in the RAM 106 is initialized. That is, the index i of the index register is reset to 0, and the residual time $t_1$ stored in the timer block having the address number TMB+0 in the soft time table is checked. In this case, $t_1=t_0$. Then, in step 630, judgment is made as to whether or not the soft timer checked in step 628 is in its stop state. The soft timer is judged to be in its stop state when the residual time $t_1$ stored in the timer block of the soft timer table is proved to be $t_1=0$, and the task to be activated by this soft timer is judged to be in its deactivated state. In such a case, the program jumps to step 640 in which the timer block of the soft timer table is updated.

When, on the other hand, the result of judgment in step 630 proves that the residual time $t_1$ of the timer block of the soft timer table is $t_1 \neq 0$, the residual time stored in the aforesaid timer block is updated in step 632. That is, 1 is decremented from the residual time $t_1$. Then, in step 634, judgment is made as to whether or not the activation period for the specific soft timer in the soft timer table has been reached. It is judged that the activation period for the soft timer has been reached when the residual time $t_1$ is proved to be $t_1=0$, and step 636 is followed. When the result of judgment in step 634 is "NO", the program jumps to step 640 in which the timer block of the soft timer table is updated. When, on the other hand, the result of judgment in step 634 is "YES", the residual time $t_1$ of the timer block of the soft time table is initialized in step 636. That is, the time information of the activation period for the specific task is transferred from the ROM 104 to the RAM 106. After the initialization of the residual time $t_1$ of the timer block of the soft timer table in step 636, activation of the specific task corresponding to the timer block of the soft timer table is requested in step 638. Then, in step 640, the timer block of the soft timer table is updated. That is, 1 is incremented to the index of the index register. Finally, in step 642, judgment is made as to whether or not all of the timer blocks of the soft timer table have been checked. In the present embodiment, there are (n+1) timer blocks in the soft timer table. Therefore, when the index i of the index register indicates that $i=n+1$, it is judged that all of the timer blocks in the soft timer table have been checked, and the INTV interrupt processing program 606 ends in step 644. On the other hand, when the result of judgment in step 642 is "NO", the program returns to step 630 to repeat the above manner of processing.

In the manner above described, activation of tasks corresponding to various interrupts are requested so that such tasks can be executed in response to the interrupts. However, all of the tasks in the task group shown in Table 2 are not always executed, and, on the basis of information of the operating condition of the engine, the time information pertinent to the activation periods for the required tasks in the task group stored in the ROM 104 are selectively transferred from the ROM 104 to be stored in the soft timer table provided in the RAM 106. When the activation period for a given task is, for example, 20 msec, this specific task is activated every 20 msec. When this specific task is required to be continuously activated depending on the operating condition of the engine, the timer block of the soft timer table corresponding to that task is continuously updated and initialized.

Figure 14:
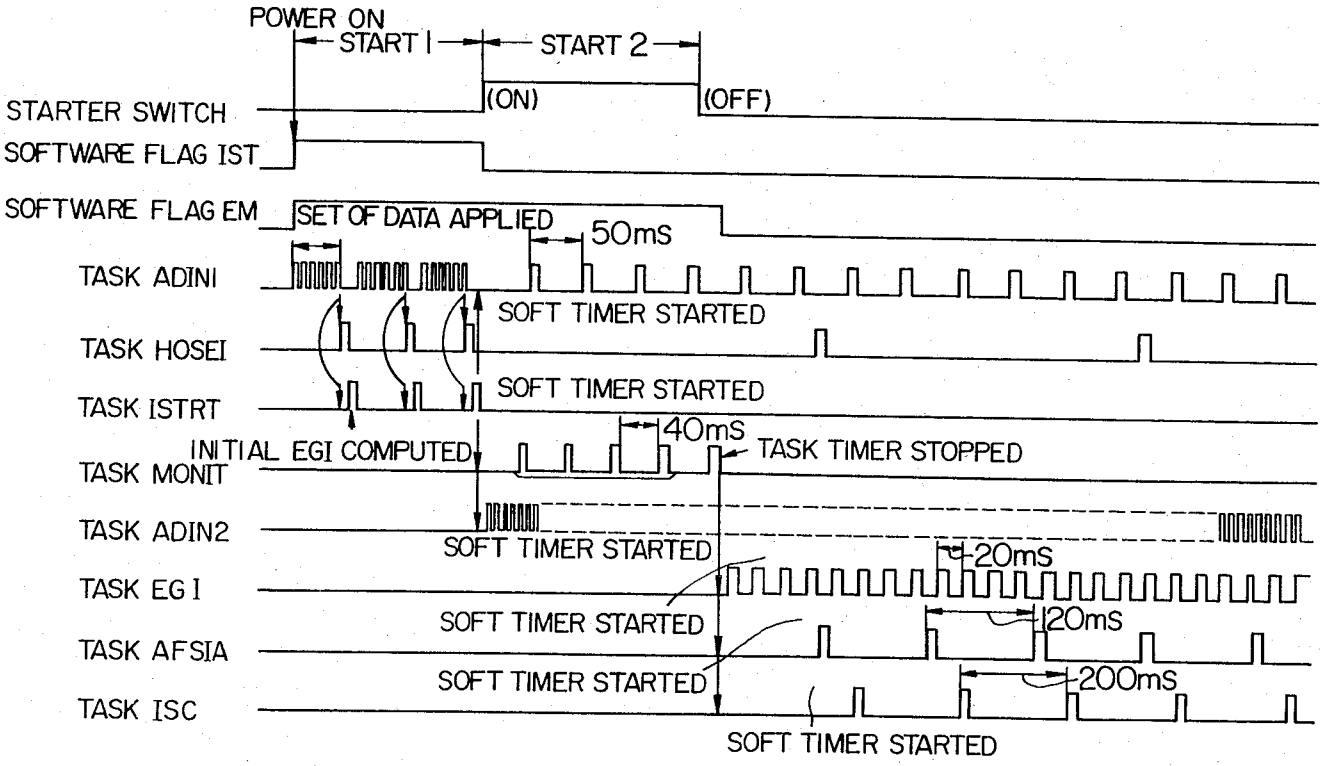
FIG. 14 is a time chart showing how various tasks are activated and deactivated depending on the operating condition of the engine.

FIG. 14 is a time chart illustrating how the various tasks in the task group are activated and deactivated in response to the various interrupts depending on the operating condition of the engine. The CPU 102 operates in response to the state of power-on established by manipulation of the START-SW 152 shown in FIG. 2, and software flags IST and EM are turned into "1" level. The software flag IST is a flag which indicates that the engine is in its pre-starting stage, and the software flag EM is a flag which indicates that the ENST interrupt is inhibited. On the basis of these two flags, whether the engine is in its pre-starting stage, or the engine is being started or the engine has been started can be discriminated.

When the state of power-on is established by manipulation of the START-SW 152, the task ADIN1 is first activated so that the various sensor output signals indicative of the data of the cooling water temperature, battery voltage, etc. required for starting the engine are sequentially applied as information inputs to the ADC 122 through the MPX 120. After application of one set of these data, the task HOSEI is activated to make necessary computation for correction on the basis of the above information inputs. Further, after application of one set of the data from the various sensors to the ADC 122 by activation of the task ADIN1, the task ISTRT is activated for computation of the quantity of fuel required in the starting stage of the engine. The three tasks above described, that is, the tasks ADIN1, HOSEI and ISTRT are activated according to the initial processing program 202.

When the START-SW 152 is turned on, the tasks ADIN1, MONIT and ADIN2 are activated in response to the interrupt signal generated by activation of the task ISTRT. These tasks are required to be executed during only the period of time in which the START-SW 152 is in its on-state, that is, in the engine cranking stage. In this period, the time information of predetermined activation periods are transferred to and stored in the timer blocks of the soft timer table corresponding to these tasks respectively and provided in the RAM 106. During the engine cranking period, the residual time $t_1$ of the activation period in the soft timer table is initialized to repeat the setting of the activation period. The task MONIT is executed for computing the quantity of fuel injected in the engine starting stage and is unnecessary after the engine is started. Upon execution of the task MONIT a predetermined number of times, energization of the soft timer is ceased, and the group of tasks, other than the above and required after the engine is started, are activated in response to the stop signal generated after the completion of the task MONIT. For this purpose, zero (o) is stored in the timer block of the soft timer table corresponding to the specific task by the signal generated upon judgment of the completion of the task to indicate that the task is completed. That is, the soft timer is cleared to stop execution of the specific task. Therefore, according to the present invention, a task can be simply activated and deactivated by the function of an associated soft timer so that a plurality of tasks having different activation periods can be efficiently and reliably controlled.

In the embodiment of the present invention, the instantaneous quantity of intake air is continuously sensed to be AD converted. Therefore, fuel can be injected in the quantity corresponding to variations of the quantity of intake air, and any especial fuel control to deal with acceleration and deceleration is not required except when the engine is under abrupt acceleration or deceleration.

In the embodiment of the present invention, the integration air quantity level is suitably shifted for the adjustment of the air-fuel ratio. Therefore, the air-fuel ratio can be controlled with the accuracy higher than in the case of the prior art control in which the quantity of fuel is varied.

The present invention can provide an expensive fuel injection control apparatus by virtue of the fact that the fuel injection timing is not synchronous with rotation of the engine, and the operation range of the fuel supply system can be correspondingly narrowed.

In the embodiment of the present invention, the timer associated with the INTV interrupt is provided separately from the timer associated with the AD conversion of the instantaneous air quantity. However, these two timers may be replaced by a single timer. Further, fuel may be injected in synchronous relation with rotation of the engine in the starting stage or low-speed rotation range of the engine, and the method of the present invention may only be applied to the high-speed rotation range of the engine.

It will be understood from the foregoing detailed description that the present invention can make close adjustment of the air-fuel ratio and can always reliably control the quantity of fuel to meet acceleration and deceleration of the engine. Therefore, discharge of harmful engine exhaust gases can be suppressed to a minimum, and the optimized control of fuel supplied to the engine can be achieved. Further, the control function required for the supply system can be simplified.

What we claim is:

1. In a fuel control system including:

a plurality of sensors sensing various operation parameters of an engine;

a digital computer for controlling the quantity supplied to the engine depending on the outputs from said sensors;

a pulse generating circuit for generating a pulse signal for controlling the quantity of supplied fuel in response to the output from said digital computer; and fuel supplying means for supplying fuel on the basis of the pulse signal generated from said pulse generating circuit, a method of controlling fuel supplied to the engine comprising the steps of:

computing the quantity of air taken into the engine on the basis of the output from one of said sensors;

integrating the quantity of intake air computed in the first step;

determining the level for setting the period of generation of the pulse signal on the basis of the output from one of said sensors; and generating pulses of predetermined pulse width from said pulse generating circuit when the integrated value of the quantity of intake air in the second step reaches the level set in the third step such that the period of generation of said pulse and hence the timing of the fuel supply is varied depending on the integrated value and the set level.

2. A method as claimed in claim 1, wherein, in said third step, said level is determined on the basis of the output from an exhaust gas sensor sensing the $O_2$ content in the exhaust gases.

3. In a fuel control system including:

a plurality of sensors sensing various operation parameters of an engine;

a digital computer for controlling the quantity of fuel supplied to the engine depending on the outputs from said sensors;

a pulse generating circuit for generating a pulse signal for controlling the quantity of supplied fuel in response to the output from said digital computer; and fuel supply means for supplying fuel on the basis of the pulse signal generated from said pulse generating circuit, a method of controlling fuel supplied to the engine comprising the steps of:

computing the quantity of air taken into the engine on the basis of the output from one of said sensors;

integrating the quantity of intake air computed in the first step;

determining the level for setting the period of generation of the pulse signal on the basis of an output from exhaust gas sensors sensing the $O_2$ content in the exhaust gases, wherein judgment is made as to whether the air fuel ratio indicated from the output from said exhaust gas sensor is lean or rich relative to a predetermined setting of the air-fuel ratio, and said level is so set that the period of fuel supply is decreased and increased when the result of judgment proves that the air-fuel ratio indicated by said sensor output is lean and rich relative to said air-fuel ratio setting respectively; and generating pulses of a predetermined pulse width from said pulse generating circuit when a predetermined relationship is attained between the level determined in the third step and the result of integration in the second step.

4. A method as claimed in claim 1, wherein, in said third step, said level is set on the basis of the quantity of intake sensed by a sensor when the engine is operating in its high-power range.

5. A method as claimed in claim 1, wherein, in said third step, said level is set on the basis of the temperature of engine cooling water sensed by a sensor.

* * * * *